US006799715B1

(12) United States Patent
Bennett et al.

(10) Patent No.: US 6,799,715 B1
(45) Date of Patent: Oct. 5, 2004

(54) SLICEABLE PRODUCT CONTAINER DEVICE

(76) Inventors: Thomas G. Bennett, 1613 Extension Road, Nanaimo, British Columbia (CA), V9X 1A6; Toni L. Bennett, 1613 Extension Road, Nanaimo, British Columbia (CA), V9X 1A6

( * ) Notice: Subject to any disclaimer, the term of this patent is extended or adjusted under 35 U.S.C. 154(b) by 197 days.

(21) Appl. No.: 10/201,036

(22) Filed: Jul. 23, 2002

(51) Int. Cl.[7] ..... B65D 5/54

(52) U.S. Cl. ..... 229/101.1; 229/101.2; 229/206; 426/122; 426/123; 426/130

(58) Field of Search ..... 229/101.1, 101.2, 229/101, 206, 924; 426/122, 123, 130

(56) References Cited

U.S. PATENT DOCUMENTS 1,598,951 A * 9/1926 Wright ..... 426/87
2,299,853 A * 10/1942 Slonneger ..... 83/200.1
2,447,096 A * 8/1948 Schneider ..... 229/101.1
2,969,902 A * 1/1961 Cage ..... 229/4.5
3,304,185 A * 2/1967 Fortney ..... 426/122
3,343,746 A * 9/1967 Shiffman ..... 229/120.011
4,091,929 A * 5/1978 Krane ..... 229/101.1
5,626,250 A * 5/1997 Dorazio ..... 220/4.26

* cited by examiner

*Primary Examiner*—Tri M. Mai

(57) ABSTRACT

A sliceable product container device for sectioning a container of ice cream into equal portions. The sliceable product container device includes a container having a base wall and also having a plurality of band members forming a side wall of the container and having a base band member being securely attached upon the base wall; and also includes a plurality of peal-able sealing strips for removably attaching the band members together to form the side wall of the container; and further includes a lid being removably disposed upon the container; and also includes a fastening strip being attached to the band members; and further includes an assembly of cutting ice cream into sections for easy removal from the container.

2 Claims, 4 Drawing Sheets

SLICEABLE PRODUCT CONTAINER DEVICE

BACKGROUND OF THE INVENTION

1. Field of the Invention

The present invention relates to sectioned ice cream containers and more particularly pertains to a new sliceable product container device for sectioning a container of ice cream into equal portions.

2. Description of the Prior Art

The use of sectioned ice cream containers is known in the prior art. More specifically, sectioned ice cream containers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,091,929; 3,957,773; 4,349,110; 3,343,746; 2,969,902; and Des. 124,755.

While these devices fulfill their respective, particular objectives and requirements, the aforementioned patents do not disclose a new sliceable product container device. The prior art describes inventions having containers being formed from bands being detachably connected one upon another.

SUMMARY OF THE INVENTION

The general purpose of the present invention, which will be described subsequently in greater detail, is to provide a new sliceable product container device which has many of the advantages of the sectioned ice cream containers mentioned heretofore and many novel features that result in a new sliceable product container device which is not anticipated, rendered obvious, suggested, or even implied by any of the prior art sectioned ice cream containers, either alone or in any combination thereof. The present invention includes a container having a base wall and also having a plurality of band members forming a side wall of the container and having a base band member being securely attached upon the base wall; and also includes a plurality of peal-able sealing strips for removably attaching the band members together to form the side wall of the container; and further includes a lid being removably disposed upon the container; and also includes a fastening strip being attached to the band members; and further includes an assembly of cutting ice cream into sections for easy removal from the container. None of the prior art describes a flexible line being used to cut the ice cream into equal sections.

There has thus been outlined, rather broadly, the more important features of the sliceable product container device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new sliceable product container device which has many of the advantages of the sectioned ice cream containers mentioned heretofore and many novel features that result in a new sliceable product container device which is not anticipated, rendered obvious, suggested, or even implied by any of the prior art sectioned ice cream containers, either alone or in any combination thereof.

Still another object of the present invention is to provide a new sliceable product container device for sectioning a container of ice cream into equal portions.

Still yet another object of the present invention is to provide a new sliceable product container device that is easy and convenient to use.

Even still another object of the present invention is to provide a new sliceable product container device that eliminates waste and also the mess associated with trying to dip out ice creamy from a container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
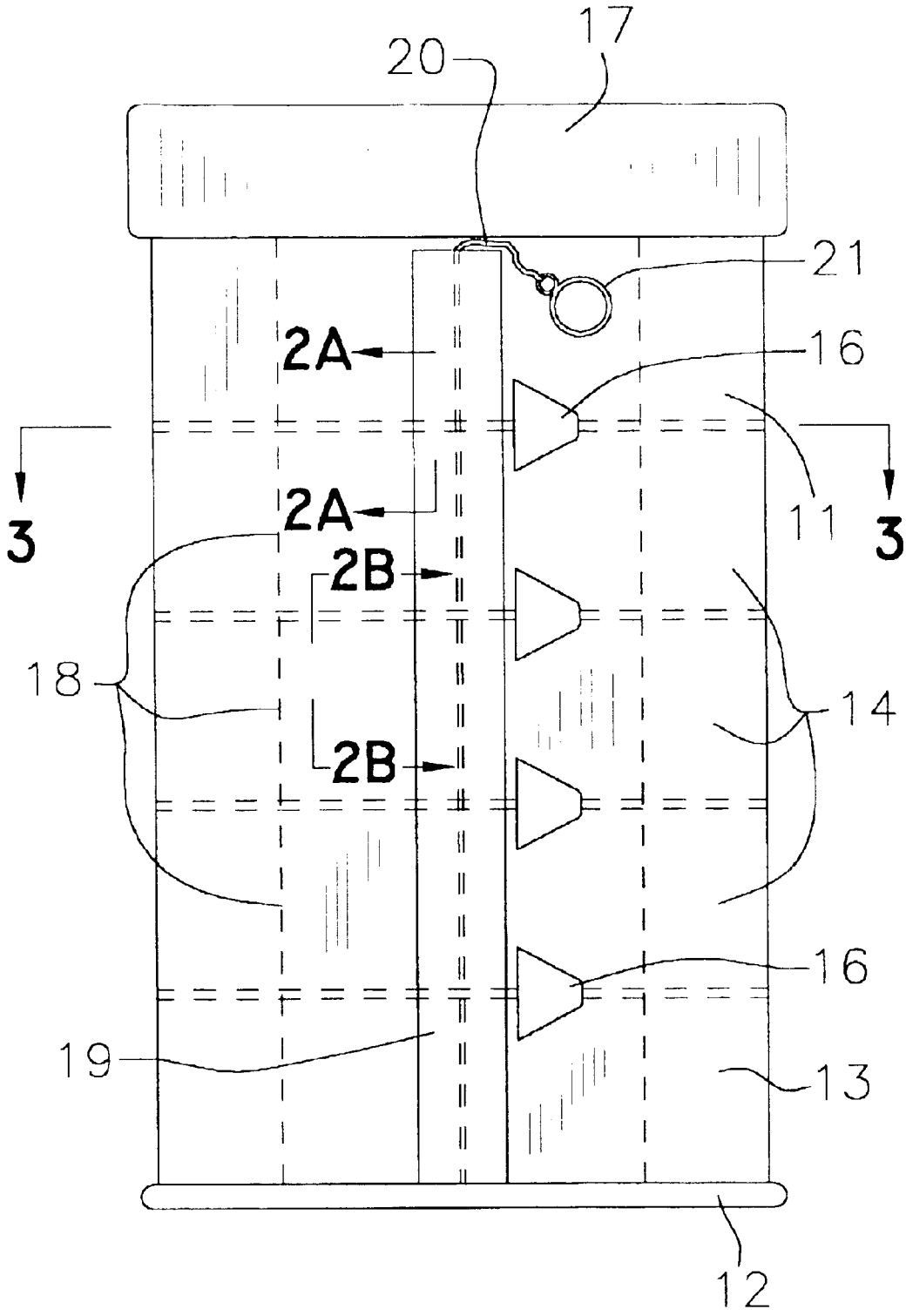
FIG. 1 is a side elevational view of a new sliceable product container device according to the present invention and shown in use.
Figure 2A:
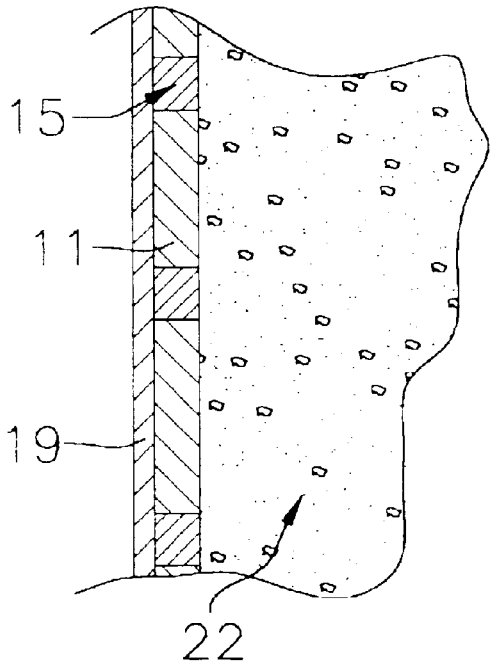
FIG. 2A is a partial cross-sectional view of the fastening strip of the present invention.
Figure 2B:
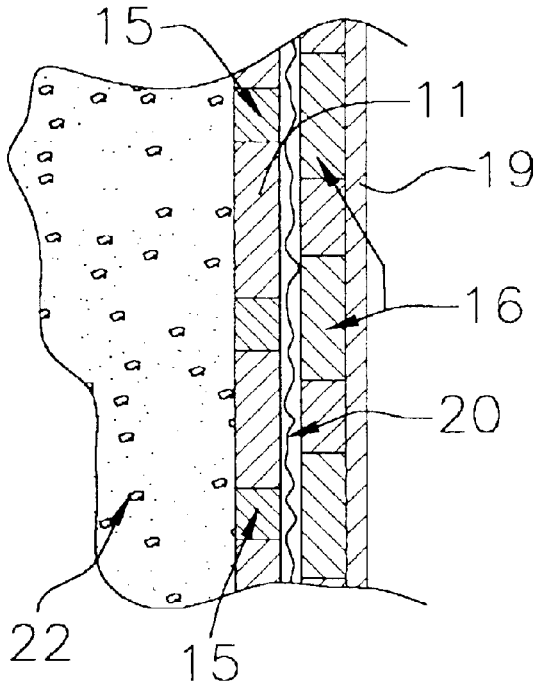
FIG. 2B is a partial cross-sectional view of the fastening strip of the present invention.
Figure 3:
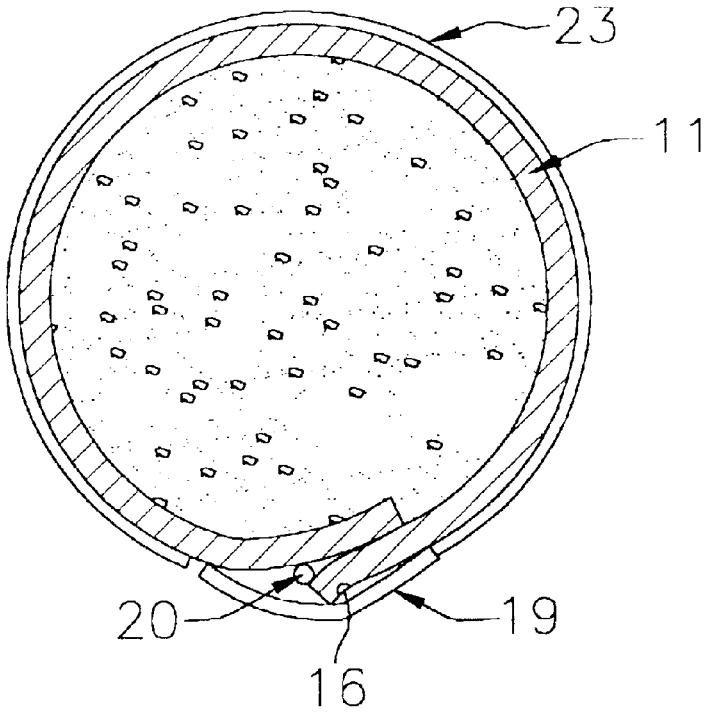
FIG. 3 is a lateral cross-sectional view of the present invention.
Figure 4:
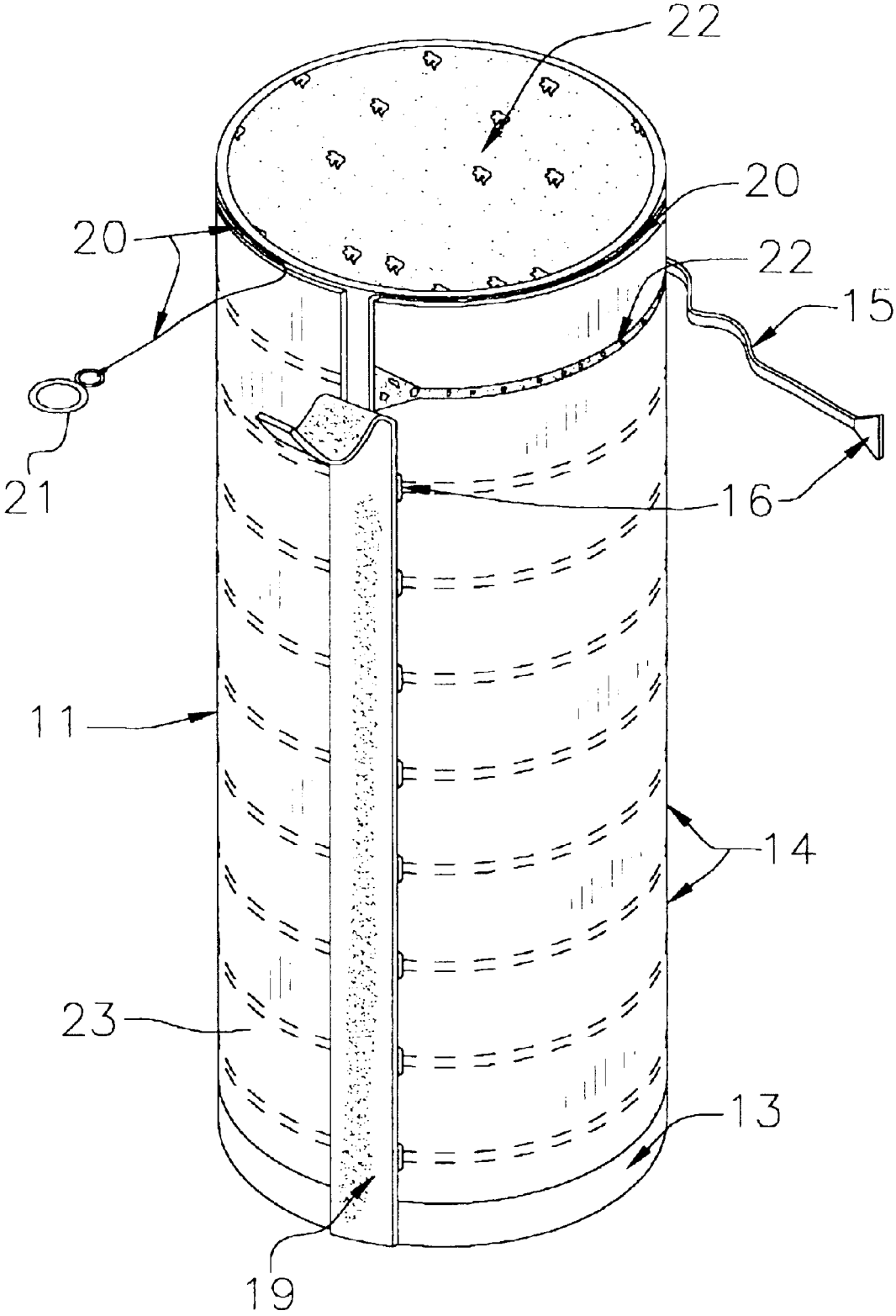
FIG. 4 is a perspective view of the present invention.
Figure 5:
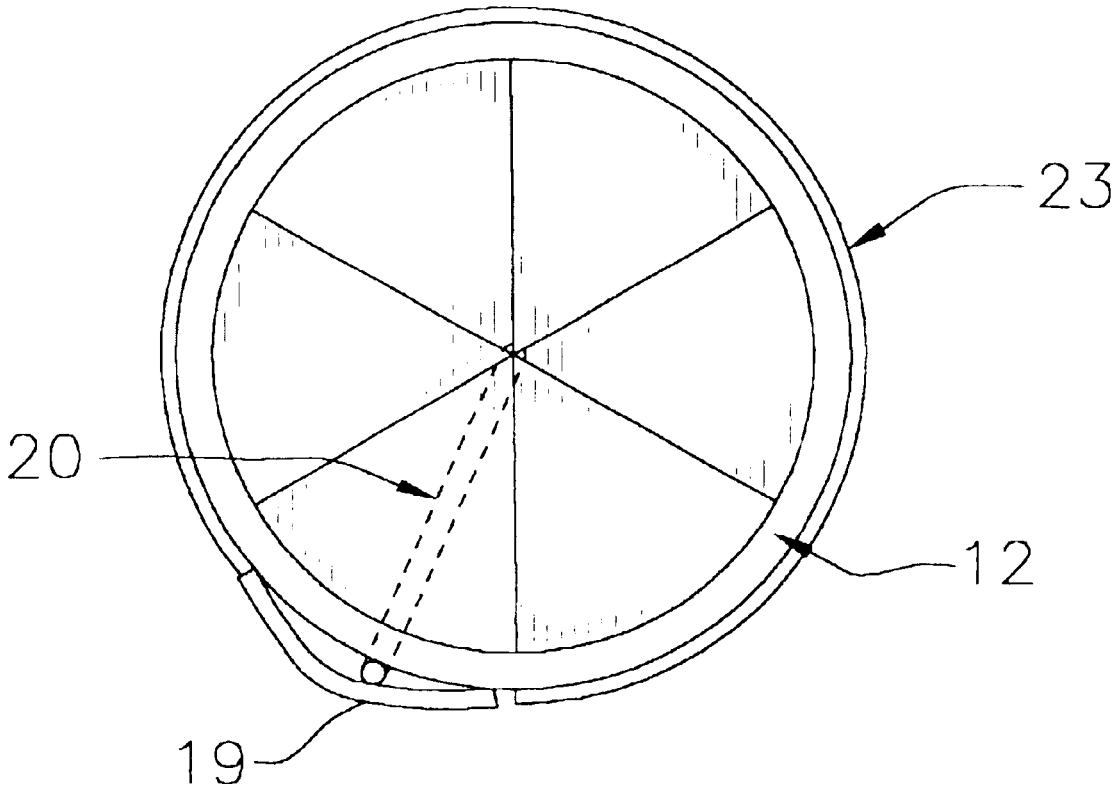
FIG. 5 is a bottom plan view of the present invention.

With reference now to the drawings, and in particular to FIGS. 1 through 5 thereof, a new sliceable product container device embodying the principles and concepts of the present invention and generally designated by the reference numeral 10 will be described.

As best illustrated in FIGS. 1 through 5, the sliceable product container device 10 generally comprises a container 11 having a base wall 12, and also having a plurality of band members 13,14 forming a side wall of the container 11 and having a base band member 13 being securely and conventionally attached upon the base wall 12, and also having a conventional product label 23 being conventionally attached to the side wall. The band members 13,14 have definite widths which are generally equivalent to one another. The band members 13,14 are disposed generally one upon another to form the side wall of the container 11. As a second embodiment, each of the band members 13,14 further have dashed tear lines 18 being spaced apart and extending across the width thereof for allowing stripping off sections of the band members 13,14 from about the ice cream 22.

A plurality of peal-able sealing strips 15 for removably attaching the band members 13,14 together to form the side wall of the container 11 are conventionally disposed between the band members 13,14 with each of the peal-able sealing strips 15 being detachably and conventionally attached along circumferential edges of pairs of the band members 13,14. Each of the peal-able sealing strips 15 includes a strip of material and a tab member 16 being conventionally attached at an end thereof for detaching the sealing strip 15 from the band members 13,14. A lid 17 is removably disposed upon the container 11.

A fastening strip 19 is conventionally attached and adhered to the band members 13,14. The fastening strip 19 is removably and securely attached and adhered with adhesive to outer sides of the band members 13,14 and to the peal-able sealing strips 15 and extends from the base wall 12 to a top of the container 11 to prevent unwanted removal of the peal-able sealing strips 15. The fastening strip 19 crosses the peal-able sealing strips 15 near the tab members 16.

A means of cutting ice cream 22 into sections for easy removal from the container 11 includes a flexible line 20 having a first end being securely and conventionally attached to the base wall 12 and being removably secured to an exterior of the container 11 with the fastening strip 19 for cutting laterally through the ice cream 22 along where a sealing strip 15 is removed, and also includes a finger-receiving ring 21 being conventionally attached to a second end of the flexible line 20 into which a user extends one's finger and moves the flexible line 20 through the ice cream 22 and separates the ice cream 22 into manageable sections.

In use, the user peals back a portion of the fastening strip 19, and then strips off an uppermost sealing strip 15 by grasping the tab member 16 and pulling the sealing strip 15 away from the container 11, and then places a finger in the finger-receiving ring 21, and moves the flexible line 2*o* along where the sealing strip 15 was removed to cut the ice cream 22 into a section which can be easily removed from the container 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the sliceable product container device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A sliceable product container device comprising:

a container having a base wall and also having a plurality of band members forming a side wall of said container and having a base band member being securely attached upon said base wall, and further having a product label attached to said side wall, said band members having definite widths which are generally equivalent to one another, said band members being disposed generally one upon another to form said side wall of said container, each of said band members further having dashed tear lines being spaced apart and extending across the width thereof for allowing stripping off sections of said band member from about the ice cream;

a plurality of peal-able sealing strips for removably attaching said band members together to form said side wall of said container;

a lid being removably disposed upon said container;

a fastening strip being attached to said band members; and a means of cutting ice cream into sections for easy removal from said container.

2. A sliceable product container device comprising:

a container having a base wall and also having a plurality of band members forming a side wall of said container and having a base band member being securely attached upon said base wall, and further having a product label attached to said side wall, said band members having definite widths which are generally equivalent to one another, said band members being disposed generally one upon another to form said side wall of said container;

a plurality of peal-able sealing strips for removably attaching said band members together to form said side wall of said container, said peal-able sealing strips being disposed between said band members with each of said peal-able sealing strips being detachably attached along circumferential edges of pairs of said band members, each of said peal-able sealing strips including a strip of material and a tab member being attached at an end thereof for detaching said sealing strip from said band members;

a lid being removably disposed upon said container;

a fastening strip being attached to said band members, said fastening strip being removably and securely attached to outer sides of said band members and to said peal-able sealing strips and extending from said base wall to a top of said container to prevent unwanted removal of said peal-able sealing strips, said fastening strip crossing said peal-able sealing strips near said tab members; and a means of cutting ice cream into sections for easy removal from said container said means of cutting the ice cream into sections including a flexible line having a first end being securely attached to said base wall and being removably secured to an exterior of said container with said fastening strip for cutting laterally through the ice cream along where a said sealing strip is removed, and also including a finger-receiving ring being attached to a second end of said flexible line to which a user extends one's finger and moves said flexible line through the ice cream and separates the ice cream into sections.

* * * * *